US005191777A

United States Patent [19]

Schnegg

[11] Patent Number: 5,191,777

[45] Date of Patent: Mar. 9, 1993

[54] WEFT INSERTED, WARP KNIT, WOVEN-LOOK FABRIC AND APPARATUS AND METHODS OF MAKING THE FABRIC

[75] Inventor: Julius R. Schnegg, Burlington, N.C.

[73] Assignee: Burlington Industries, Inc., Greensboro, N.C.

[21] Appl. No.: 582,340

[22] Filed: Sep. 14, 1990

Related U.S. Application Data

[63] Continuation-in-part of Ser. No. 329,368, Mar. 27, 1989, abandoned.

[51] Int. Cl.[5] ..... D04B 21/14

[52] U.S. Cl. ..... 66/195; 66/190; 66/192

[58] Field of Search ..... 66/190, 192, 193, 195

[56] References Cited

U.S. PATENT DOCUMENTS

| | | | |
|---|---|---|---|
| 3,567,565 | 3/1971 | Jones et al. | 66/190 X |
| 4,615,934 | 10/1986 | Ellison | 66/190 X |
| 4,722,203 | 2/1988 | Darjee | 66/190 X |
| 4,841,749 | 6/1989 | Petracek et al. | 66/190 |

FOREIGN PATENT DOCUMENTS

| | | | |
|---|---|---|---|
| 8401969 | 5/1984 | European Pat. Off. | 66/190 |
| 8700565 | 1/1987 | European Pat. Off. | 66/190 |
| 1585047 | 11/1969 | Fed. Rep. of Germany | 66/190 |
| 477899 | 10/1953 | Italy | 66/190 |
| 0947237 | 7/1982 | U.S.S.R. | 66/190 |
| 1154388 | 5/1985 | U.S.S.R. | 66/190 |

*Primary Examiner*—Peter Nerbun
*Assistant Examiner*—John J. Calvert
*Attorney, Agent, or Firm*—Nixon & Vanderhye

[57] ABSTRACT

Warp and weft yarns are alternately laid one on top of the other and the weft yarns are stitched to provide a woven-like fabric appearance. At least one weft yarn is provided in each stitch course between the stitch loop and the underlap, the stitching forming no part of the interlacing and the woven-like fabric appearance.

28 Claims, 6 Drawing Sheets

Fig. 1
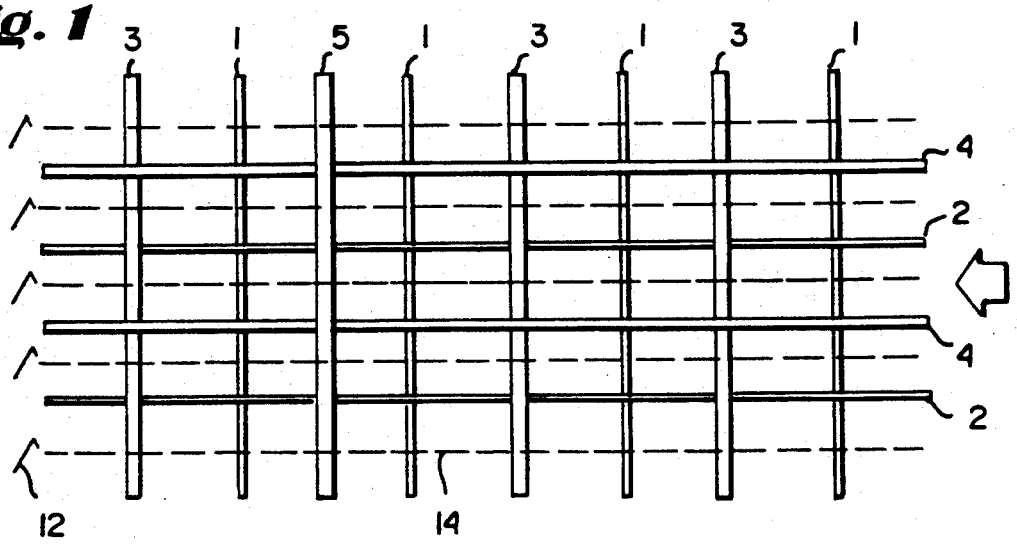
Fig. 3
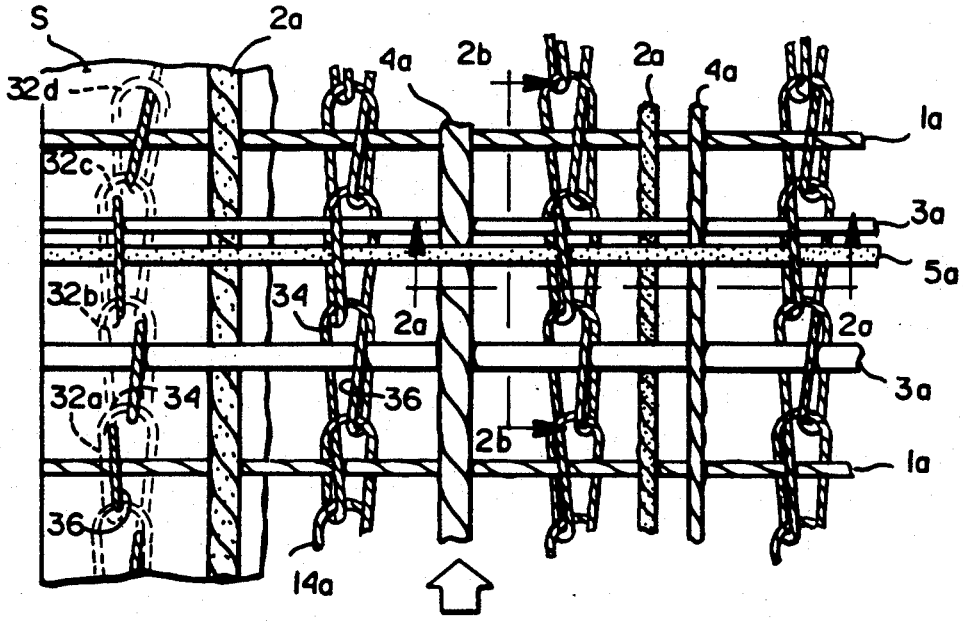
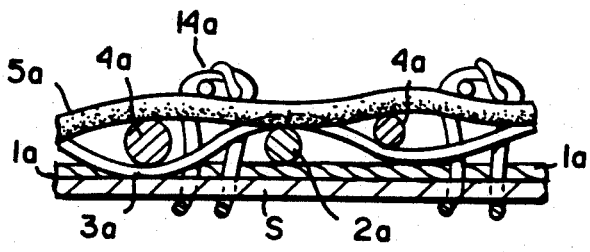
Fig. 2a

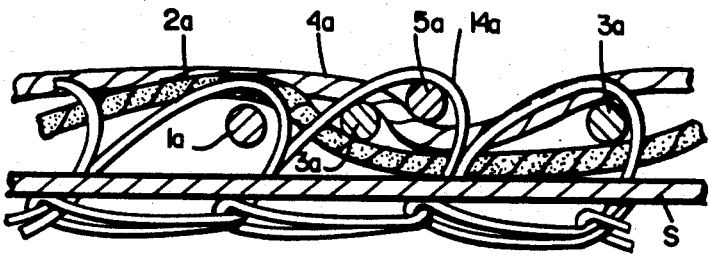
Fig. 2b
Fig. 4
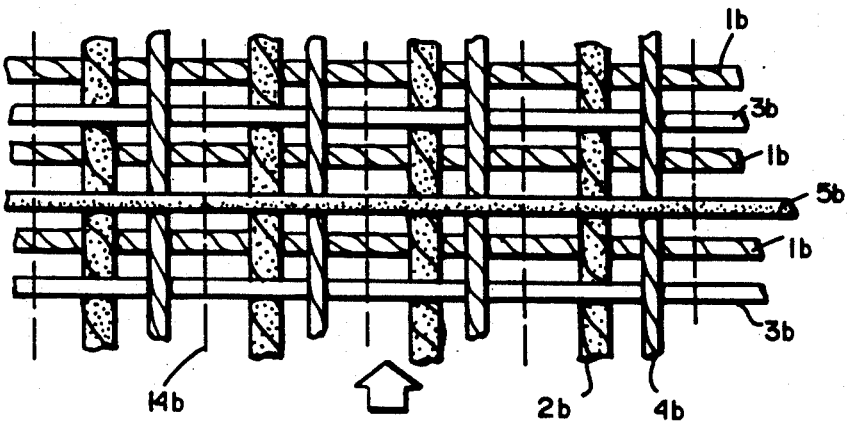
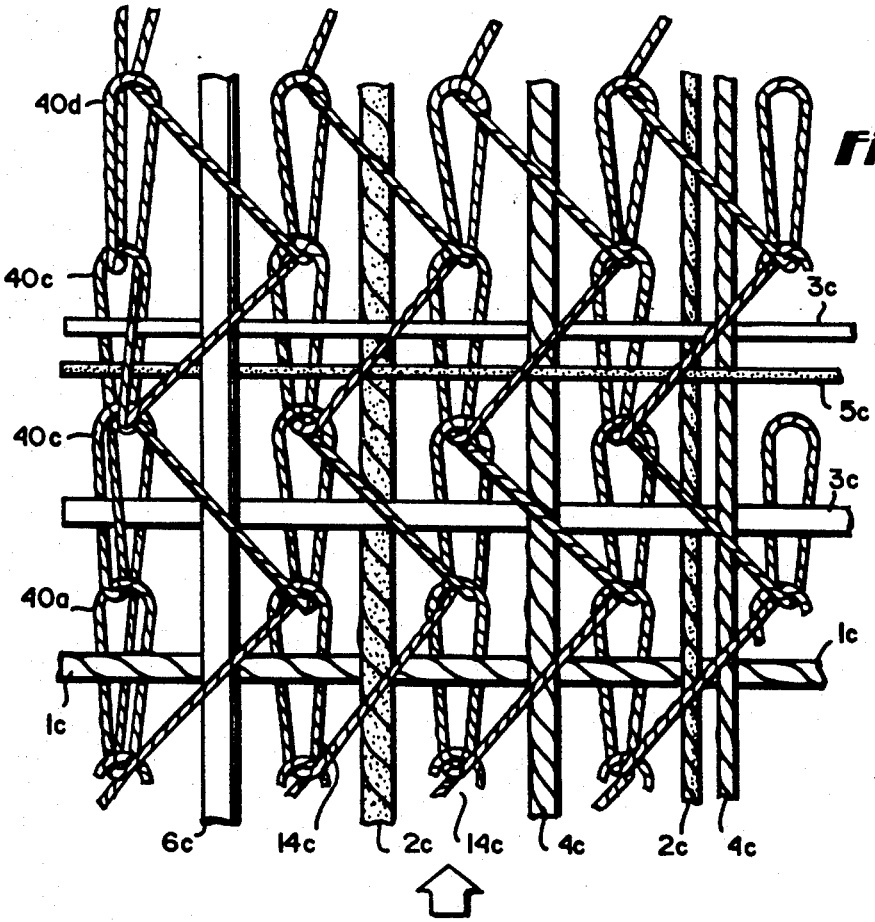
Fig. 5

WEFT INSERTED, WARP KNIT, WOVEN-LOOK FABRIC AND APPARATUS AND METHODS OF MAKING THE FABRIC

RELATED APPLICATIONS

This application is a continuation-in-part of application Ser. No. 07/329,368, filed Mar. 27, 1989, now abandoned.

BACKGROUND AND SUMMARY OF THE INVENTION

The present invention relates to a knitted fabric which has a look and feel similar to woven fabrics and to apparatus and methods of making such fabric. Particularly, the present invention relates to weft inserted, warp knit woven-appearing fabric having aesthetic and structural characteristics similar to those of conventional woven fabric and to apparatus and methods of making such fabric.

Efforts have previously been made to produce fabric which has the aesthetics, dimensional stability, drapability and other characteristics of woven fabric but which may be produced with the production speed and other advantages of knitting, for example, by warp knit weft insertion machines. As well known, woven fabrics have dominated the marketplace because of their very desirable characteristics including their stability and capacity to be made in an almost limitless variety of patterns. Warp knit, weft insertion machinery, however, has the ability to increase the speed of production of a fabric, as well as to use inferior yarn, in some cases, as compared to even the fastest of weaving machines. Warp knit, weft insertion fabric is also quite stable. However, the advantages afforded by its higher fabric production speed are offset to some extent by the increase in yarn usage necessary to produce textures, patterns or depth of fabrics similar to those characteristics in woven fabrics.

In order to provide a woven look-alike fabric by a warp knit, weft insertion technique, a fabric construction is necessary which affords the impression and aesthetics of being woven. This usually requires more yarn and is therefore more costly. Also, its effect is seldom satisfying. That is, it is usually sufficiently different from a woven fabric construction as to be deficient in certain desired characteristics, i.e., structural stability, the ability to create a variety of patterns, capacity for utilizing different yarns, etc.

One effort to provide a knit fabric having a woven appearance is described in U.S. Pat. No. 3,952,550. In this patent, an objective is to provide a fabric which has a woven appearance from both sides of the fabric. In this fabric, the warp-weft configuration is interlaced with the stitching construction. That is, a stitching construction is incorporated with the warp-weft configuration in order to hide the stitch loops or underlaps to the extent possible, thereby to enhance the woven-like features of the knitted fabric. More particularly, the fabric construction of this patent is such that the first weft is held between the loop portion and underlap portion of the stitch, as well as under the warp yarn between stitch wales. The second weft within the stitch is on top of the underlap portion of the stitch and under the warp yarn between stitch rows. In this manner, the stitching forms part of the interlacing of the warp and weft. The construction of the fabric disclosed in this patent is also limited to at least two wefts within a course. The knitted fabric of this patent, moreover, cannot avoid a large number of relatively closely spaced stitch wales in order to incorporate the stitching construction with the warp and weft construction to provide the woven appearing fabric. This, however, substantially increases costs as the greater the number of stitches, the greater the expense of producing the fabric. Moreover, the apparatus necessary to make the knit fabric of that patent is highly complex, limiting the weft yarns and weft repeats to one or two different kinds, thereby limiting the texture and color of yarns employable with the apparatus. It also renders it extremely difficult to provide fabrics in different patterns, such as checks, tight or open areas in the cloth, etc.

In accordance with the present invention, a warp knit, weft inserted, fabric may be formed to provide a woven appearance in relation to the warp and weft between stitch wales but which does not use the stitch wales themselves as part of the woven look-alike interlacing of the warp and weft. That is, the present invention provides a warp knit, weft inserted, woven look-alike fabric wherein the warp-weft configuration is independent of and does not include the stitching construction in the warp-weft interlacing scheme. It is also possible in accordance with the present invention to lay a weft yarn over a warp yarn and under one or more adjacent warp yarns in the same course by providing two or more each of weft carriers and warp beams. Consequently, in the present construction, one or more weft yarns are laid by a weft carrier, for example, between chains on opposite sides of the fabric and which chains transport the yarn in the warp direction. Downstream of the first weft carrier, there is provided one or more warp yarns laid on top of the first layer of wefts, thus, locating the first wefts below the first warps. Further downstream, a second weft carrier lays one or more additional wefts on top of the first warps and further downstream, yet another one or more warp yarns are laid on top of the second weft yarns. Preferably, but not necessarily, the second weft yarns are laid alternately between the first weft yarns and similarly the second warp yarns ar laid, preferably alternately, between the first warp yarns. Preferably, none of the weft yarns register with one another. It will be appreciated that the sequence may be continued with third and additional weft and warp yarns being laid in this interlaced pattern to fill the fabric.

With this technique of interlacing warp and weft, it will also be appreciated that warp ends could be laid between the wales of stitches without covering the entirety of the weft. This would simulate a more dense fabric than the gauge of the machine would indicate. By using a relatively coarse gauge machine for a visually denser fabric, the quantity of stitching yarn would be reduced. Further, multiple warp ends placed between stitches tend to touch one another in warp knitting, requiring the use of more ends per unit for a particular density than in weaving, where they are slightly separated through the interlacing of warp and weft. By the slight separation of two adjacent warp ends placed between two adjacent stitching wales, yarn consumption for a given density or opacity of fabric is minimized. Similarly, use of doubled wefts lying within a course minimizes yarn usage.

The fabric formation is accomplished in accordance with the present invention such that the stitches are independent of the interlaced warp and weft. In such stitching, the first weft within one course is held between the loop portion of the stitch and the stitch underlap. As seen from the technical front of the fabric, warp yarn between the stitch wales lies under the weft. The next weft or multiples thereof in the second group of weft yarns within the next course are again located between the loop portion of the stitch and the stitch underlap. The warp yarn of the previously mentioned warp between the stitch wales, however, is now over that weft.

It will also be appreciated that one or more substrates may be incorporated into the woven-appearing fabric. The substrate is stitched to the fabric and may comprise non-woven, woven, knitted or netted material which may be substituted for any one of the laid-in weft yarn sets or on either side of the fabric.

In a preferred embodiment according to the present invention, there is provided a warp knit, weft inserted, fabric having a woven-like appearance, comprising plural stitch wales having a plurality of substantially parallel courses with the stitch in each wale at each course having a technical face side segment and a technical back side segment, a first set of weft yarns, each of which is held in the fabric by the technical back side segment, a second set of weft yarns, each of which is held in the fabric by the technical face side segment, and plural warp yarns disposed between the first and second sets of weft yarns and extending in the warp direction between predetermined adjacent stitch wales. Preferably, the stitches are chain stitches so that the technical face side segments are the loop portions of the stitches and the technical back side segments are the underlap portions of the stitches. In a further preferred embodiment, the first and second sets of weft yarns may be disposed in alternating courses, or certain courses may have no wefts therein.

In a still further preferred embodiment according to the present invention, there is provided a warp knit, weft inserted, fabric having a woven-like appearance, comprising plural stitch wales having a plurality of substantially parallel courses with the stitch in each wale at each course having a loop portion and an underlap, a first set of weft yarns each being respectively inserted in those of the chain stitches which establish selected ones of the courses such that predetermined adjacent ones of the first weft yarns are spaced one from the other in the warp direction by others of the chain stitches which establish at least one intermediate course between the selected ones of the courses in which the predetermined adjacent ones of the first weft yarns are inserted. A second set of weft yarns are each inserted in a respective at least one intermediate course. Each of the at least one intermediate course receives a weft yarn of the second set lying next adjacent one of the selected ones of the courses receiving a weft yarn of the first set with the weft yarns of the next adjacent courses bound to the fabric by the underlap of the stitches. Plural warp yarns are disposed between the first and second sets of weft yarns and extend in the warp direction between predetermined adjacent stitch wales. If desired, yarns of the first and second sets could be inserted in the same course instead of or, in addition to, alternating courses. Further, the courses with first and second sets need not be alternating, but other patterns may be used.

In a still further preferred embodiment according to the present invention, there is provided a warp knit weft inserted fabric having a laid-in warp and a relatively open woven appearance comprising a first layer of spaced-apart laid-in weft yarns, a second layer of laid-in spaced apart warp yarns and a third layer of laid-in spaced-apart weft yarns, wherein the weft yarns of the third layer are not in registration with the weft yarns of the first layer, the first, second and third layers being held together by relatively fine warp stitching yarns such that the yarns of the three layers have an interlaced woven-like appearance.

In a still further preferred embodiment according to the present invention, there is provided a method of forming a warp knit, weft inserted, fabric having woven-like appearance comprising the steps of providing plural stitch wales having a plurality of substantially parallel courses with the stitch in each wale at each course having a technical face side segment and a technical back side segment, providing the fabric with first and second sets of weft yarns, disposing plural warp yarns between the first and second sets of weft yarns and extending in the warp direction between stitch wales and holding both the first and second sets of weft yarns in the fabric by the technical back side or technical face side segments of predetermined ones of the stitches.

In a still further preferred embodiment according to the present invention, there is provided a method of forming a woven-like appearing fabric by a warp knitting, weft insertion process having plural stitch wales and courses extending in the respective warp and weft directions, comprising the steps of extending a first weft yarn set in a weft direction to establish selected ones of stitch courses such that predetermined adjacent ones of the first weft yarns are spaced one from the other in the warp direction by others of the stitch courses to establish at least one intermediate course between the selected ones of said courses, extending a first warp yarn set past the first weft yarn set, extending a second weft yarn set in the weft direction past the first warp yarn in the one intermediate course and on the side thereof opposite the first weft yarn set, forming a plurality of stitch wales between predetermined warp yarns to establish a plurality of substantially parallel courses, with the stitch in each wale at each course having a loop portion and an underlap portion. There is also provided the step of forming the stitch wales, including binding the weft yarns of each next adjacent course by the underlap of the stitches to interlace the sets of weft and warp yarns and provide a woven-like appearance.

In a still further preferred embodiment according to the present invention, there is provided apparatus for manufacturing a warp knit, weft inserted, fabric having a woven-like appearance, comprising a frame, knitting means carried by the frame and means carried by the frame for conveying weft yarns in a predetermined direction. A plurality of carriages are mounted for movement in a direction transverse to the predetermined direction for laying first and second sets of weft yarns on and between the conveying means. Also provided are means for laying warp yarns in said predetermined direction between the first and second sets of weft yarns. The knitting means for forms a plurality of stitches in plural stitch wales disposed between the warp yarns in plural, substantially parallel, courses of stitches, with the weft yarns secured in the fabric by the stitches.

In a still further preferred embodiment according to the present invention, there is provided a method of manufacturing a warp knit, weft inserted, fabric having a woven-like appearance, comprising the steps of disposing first and second sets of weft yarns sequentially on a conveyor for movement toward a knitting area, laying warp yarns on the conveyor between the first and second sets of weft yarns by laying the warp yarn on the first set of weft yarns on the conveyor and laying the second set of weft yarns upon the warp yarns, forming a plurality of stitches in plural stitch wales disposed between the warp yarns and in plural, substantially parallel courses thereof and securing the weft yarns in the fabric by the stitches.

Accordingly, it is a primary object of the present invention to provide a novel and improved weft insert warp knit woven-look fabric and apparatus and methods of making the fabric and particularly characterized by a woven look wherein the stitches are not a part of the interlaced warp and weft, but may contribute to the woven look.

These and further objects and advantages of the present invention will become more apparent upon reference to the following specification, appended claims and drawings.

BRIEF DESCRIPTION OF THE DRAWING FIGURES

FIG. 1 a diagrammatic view illustrating a method of laying up the weft and warp yarns for forming the weft inserted, warp knit, woven look-alike fabric of the present invention, with the warp direction being indicated by the arrow;

FIGS. 2*a* and 2*b* are cross sectional views of the fabric of FIG. 3 taken along the lines 2*a*—2*a* and 2*b*—2*b* in FIG. 3, respectively, looking in the direction of the arrows;

FIG. 3 is a fragmentary plan view of a representative weft inserted, warp knitted, woven look-alike fabric according to the present invention, with the warp direction being indicated by the arrow and illustrating a selvage;

FIGS. 4–6 are enlarged plan views illustrating several embodiments, respectively, of the weft inserted, warp knit fabric hereof, with FIGS. 5 and 6 illustrating the stitching for the fabric, with the warp direction being indicated by the arrow;

DETAILED DESCRIPTION OF THE DRAWING FIGURES

Figure 6:
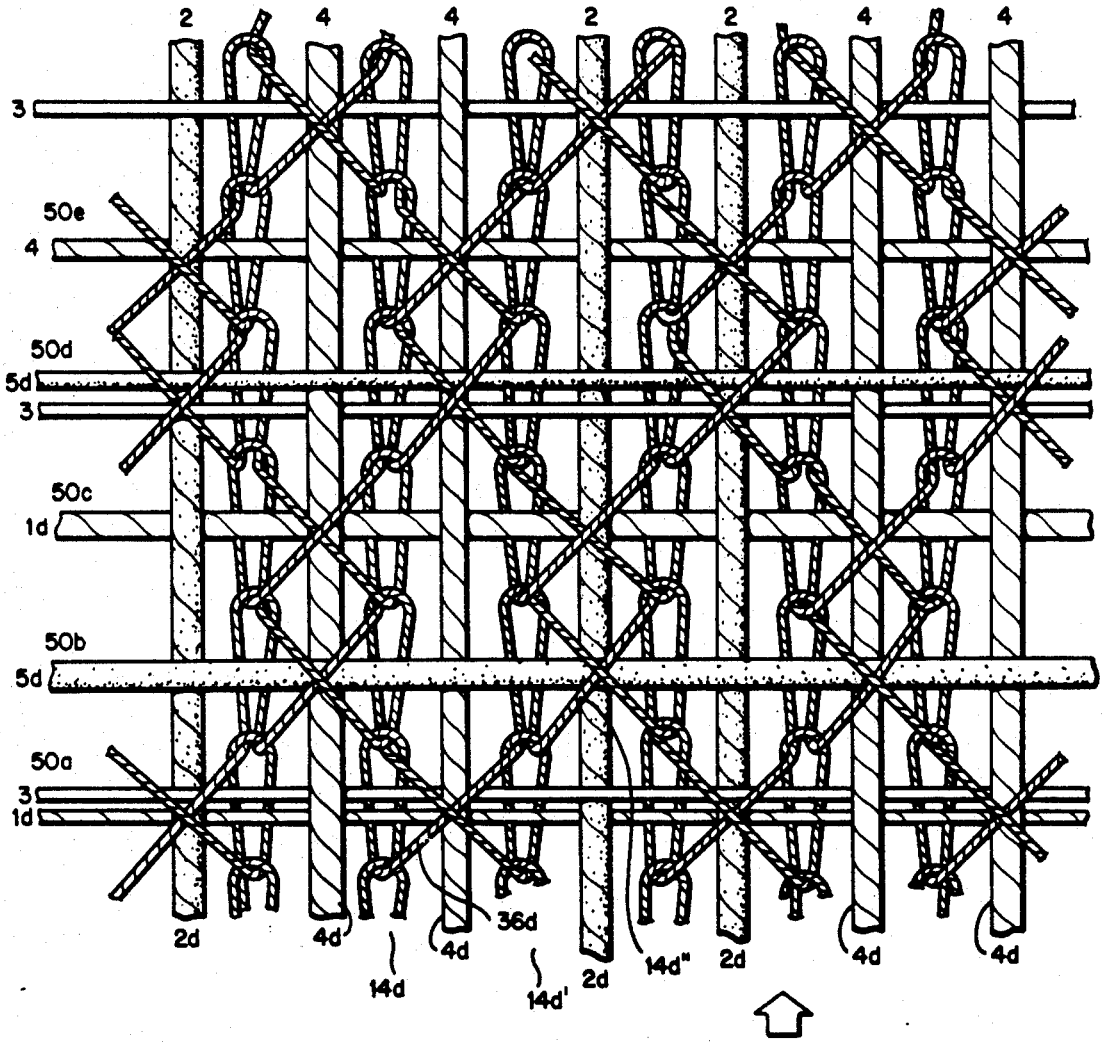

Reference will now be made in detail to the present preferred embodiment of the invention, an example of which is illustrated in the accompanying drawings.

Referring now to FIG. 1, there is illustrated a method of laying up a weft inserted, warp knit, woven look-alike fabric whereby warp and weft yarns are interlaced to provide a woven appearance. It will be appreciated that, in FIG. 1, the fabric and machine or warp direction is illustrated by the arrow 10 and the stitching needles 12 are illustrated at the lefthand side of the drawing figure. It will also be appreciated that two or more weft carriers are provided for laying down weft yarns between weft transport chains, as explained in detail in connection with FIGS. 7–8 hereof, on opposite sides of the fabric and travelling in the direction of the fabric.

For convenience, weft and warp yarns will be denoted by odd and even numbers, respectively, and the warp direction is indicated by the arrow. Also, like numbered weft yarns are laid by the same weft carrier, albeit sequentially, it being appreciated that one or a plurality of such weft yarns may be laid down for each traverse of the associated weft carrier.

As will be apparent from the ensuing description, a first weft carrier transports one or more weft yarns in a cross machine direction between the transport chains. The weft yarns carried by this first carrier are identified at 1. Downstream of the direction of movement of these weft yarns 1, warp yarns 2 are laid on top of the weft yarns 1 by a warp beam, not shown. Thus, weft yarns 1 lie below or underneath warp yarns 2 and all subsequent warp yarns, as explained hereinafter. Weft yarns 1 are later knitted in with the stitching yarn by needles 12. Downstream from the area where warp yarn 2 is laid on top of weft yarn 1, a second weft carrier, also not shown, lays one or more weft yarns 3 on top of the newly-entered warp yarns 2. Downstream from a crossing point of this second weft carrier, an additional one or more warp yarns 4 are laid on top of the weft yarns 3 and, hence, on top of weft yarns 1. Downstream from the area at which the warp yarns 4 are laid on top of the weft yarns 3, a third weft carrier, also not shown, lays wefts 5 on the newly-entering warp yarn 4, as well as warp yarn 2. Additional warp and weft yarns may be laid down as desired before any repeating or non-repeating pattern emerges.

With the foregoing arrangement, it will be appreciated that the weft yarns 3 will be disposed between and interlaced with the warp yarns 2 and 4. It will be appreciated that any one or more of the warp yarns and the weft yarns may comprise single or multiple ends. It will also be noted that subsequent weft yarns are laid between the previously laid weft yarns, such as to fill the spaces between the previously laid weft yarns, or not, depending upon the type of fabric to be produced. Thus, not each subsequent weft yarn need be disposed between the underlying weft yarns. For example, in the lay-up illustrated, the weft yarns 3 and 5 may alternate between the weft yarns 1 below and above the warp yarns 4, respectively. As will be pointed out in the ensuing description, each set of weft yarns or multiples thereof, are stitched in a single course of chain stitches.

Referring to FIGS. 2*a*, 2*b* and 3, like reference numerals are applied as in FIG. 1, followed by the letter suffix "a" to indicate weft and warp yarns similarly laid in the fabric. From a review of FIGS. 2*a*, 2*b* and 3, it will be appreciated that the interlacing of the warp and weft yarns provides a woven-like appearance to the fabric. This is further seen in FIG. 3, which is a plan view of a fabric constructed in the general manner indicated in FIG. 1, wherein the weft yarn 1*a* (single or multiple yarns) underlies all other weft or warp yarns. The warp yarn 2*a* (single or multiple yarns) overlies weft yarns 1*a*. The next weft yarn 3*a* (single or multiple yarns) overlies the warp yarns 2*a*, filling in between adjacent weft yarns 1*a*. Warp yarns 4*a* overlie the weft yarns 1*a* and 3*a* and weft yarn 5*a* of the illustrated embodiment overlies the warp yarns 2*a* and 4*a*, filling in a space between the weft yarns 1*a*, which was not filled in by the weft yarns 3*a*, and also between the weft yarns 3*a* of adjacent courses. This pattern may then be repeated.

It will be appreciated from a review of FIGS. 2*a*, 2*b* and 3 that a plurality of stitch wales 14*a*, four being illustrated in detail, interconnect the various weft yarns in a manner set forth below. Additionally, the multiple courses 32*a*–32*d* of the stitch wales are also illustrated. Each stitch wale at each course, therefore, has a loop portion 34 (i.e., a technical face side segment) and an underlap portion 36 (a technical back side segment). In this form, three weft yarn sets 1*a*, 3*a* and 5*a* are laid in in conjunction with two warp yarn sets 2*a* and 4*a*. Thus, the weft yarn sets 1*a* are laid down, followed by the warp yarns 2*a*. Weft yarn sets 3*a* are laid on top of warp yarns 2*a*, while, subsequently, warp yarns 4*a* are laid on top of weft yarn sets 3*a*, and a weft yarn set 5*a* is laid on top of the warp yarns 4*a* and 2*a*. Thus, weft yarns 3*a* are interlaced between the warp yarns 2*a* and 4*a*. Each course of stitches includes one or more of the weft yarns, and each of the weft yarn or yarns in each course lies between the loop portion 34 of the chain stitch and its underlap portion 36. Of course, other weft set arrangements may be used, including skipping one or more courses or inserting yarns for more than one weft set in a single course. For example, it will be seen that in courses 32*a* and 32*b*, weft yarns 1*a* and 3*a*, respectively, extend between the loops 34 and underlaps 36 of the respective stitches, while in stitch course 32*c*, both of weft yarns 3*a* and 5*a* lie between the loop portions 34 and underlap portions 36 of each stitch of that course. As an example of skipping one or more courses, weft yarn 3*a* can be omitted from course 32*b* and similar courses where a repeating pattern is desired. Consequently, the independent interlacing of the warp and weft yarns affords a woven-like appearance without contribution to that appearance from the stitching.

A selvage appears in FIG. 3 along the left side of the fabric. The selvage may comprise the weft yarns cut at their ends with an adjacent stitch, in this case a chain stitch holding the fabric together. A similar selvage of course, appears along the opposite side of the fabric. Additionally, a substrate may or may not be used in the fabric. A substrate S is illustrated in FIGS. 2*a*, 2*b* and 3 and may comprise a non-woven material which is stitched to the woven-like appearing fabric.

Characteristic of the present invention is the provision of a first weft yarn (single or multiple) within one course held to the fabric between the loop portion of the stitch and the stitch underlap. The warp yarn between stitch wales is under the weft yarn as seen from the technical face. The second weft yarn (single or multiple) in the next course is, similarly as the first weft yarn, held to the fabric between the loop portion of the stitch and the stitch underlap. The warp yarn between the stitch wales in that course lies over the weft yarn. In this type of construction, the woven effect is achieved in relation to the weft and warp between the stitch wales and not additionally with the stitch wales themselves. In other words, in the present invention, the filling or weft yarns are always bound by the stitching, it being appreciated that there may be none, one or more weft yarns in each course. Also, the first and second weft yarns (and subsequent weft yarns thereof) preferably do not overlie or register one another, although this is possible in this arrangement, as set forth below in conjunction with the description of the fabric of FIG. 7. Also, the warp and weft layers are held together by the stitching such that the interlaced yarns are disposed essentially in the same plane except at the cross-over points. The term "layers" as used herein refers to the sequence of the laying in of the warp and weft yarns, and not to a superposition thereof relative to one another in the final fabric because the warp and weft yarns are essentially coplanar except at their cross-over points. The foregoing description relates to chain stitches but other suitable warp knitting stitches, such as tricot stitcher, may be used.

Referring now to FIG. 4, there is illustrated another representative fabric according to the present invention with two warps and three wefts, wherein like reference numerals are applied in FIG. 1, followed by the letter suffix "b" to indicate similarly laid in weft and warp yarns. In this form, a pair of identical or different types of warp yarns 2*b* and 4*b* are disposed between each adjacent pair of stitch wales. The weft yarns lb, 3*b* and 5*b* may likewise be identical one to the other or dissimilar depending upon the pattern, texture, feel and other characteristics as desired. Weft yarns 1*b*, 3*b* and 5*b* are located, respectively, in consecutive courses of the stitch chains. Therefore, it will be appreciated that each of the weft yarns is secured in the fabric by a chain stitch in which the weft yarn is held between the loop portion of the stitch and the stitch underlap. In short, each weft yarn is bound to the fabric by the underlap of the stitch.

Referring now to FIG. 5, there is illustrated a fabric having three warp yarns and three weft yarns, with a different type of stitch, i.e., a tricot stitch. Particularly, the weft yarns include yarns 1*c*, 3*c* and 5*c* and the warp yarns include yarns 2*c*, 4*c* and 6*c*. More particularly, weft yarns 1*c* are laid down, followed by warp yarns 2*c*. Weft yarns 3*c* are laid on top of warp yarns 2*c*, while, subsequently, warp yarns 4*c* are laid on top of weft yarns 3*c*. A weft yarn 5*c* is laid on top of the warp yarns 4*c*, while a final warp yarn 6*c* is laid on top of the weft yarns. It will thus be seen that the yarns form a woven look one with the other. It will also be appreciated that each course of stitches includes zero, one or more of the weft yarns. For example, courses 40*a* and 40*b* each receive one of the weft yarns, whereas course 40*c* receives a pair of weft yarns 3*c* and 5*c* and 40*d* receives none. The stitching illustrated interconnects adjacent stitch wales as is conventional in a tricot stitch. It will be appreciated that each of the cross-over underlaps lies on the opposite side of a weft yarn from the loop portion of the stitch. As well known in the art, the stitching is accomplished by traversing a guide bar alternately back and forth so that the stitching yarns wrap around different needles in different courses. Thus, for example, the underlap extends from the stitch wale 14*c*′ in course 40*a* under the interlaced warp 2*c* and weft 1*c*, as seen from the technical front side, to form the loop in the next course 40*b* of the next adjacent stitch wale. The underlap from that loop in stitch wale 14*c*″ extends therefrom to the adjacent stitch loop in stitch wale 14*c*′ to form the loop in the next stitch course 40*c* for stitch wale 14*c*′. This cross-over stitching repeats throughout the length of the fabric. It will be noted that each weft is disposed between the loop and the underlap portion of the stitch in each course, albeit the underlap extends between the loop in one stitch wale to the loop in the next adjacent stitch wale. The lefthand selvage is illustrated in FIG. 5 with the weft yarns cut and a single chain stitch securing those yarns in the fabric. Other stitching may be used along the selvages such as a reversed tricot stitch.

In all embodiments hereof, a substrate S may be stitched to the woven-appearing fabric depending upon the desired end fabric. Also in all embodiments, the warp and weft yarns lie essentially coplanar except at their cross-over points. Preferably, the weft yarns of the various layers do not register relative to one another but rather as spaced one from the other in the machine direction.

Referring now to the embodiment hereof illustrated in FIG. 6, the warp and weft yarns are interlaced one with the other in accordance with the general scheme illustrated in FIG. 1. For example, the weft yarns 1*d* are first laid down, followed by warp yarns 2*d*. Weft yarns 3*d* are then laid down, followed by warp yarns 4*d*. A final fifth weft yarn 5*d* is then laid down. The stitching comprises a plurality of stitch wales wherein the yarns of each stitch wale cross over to form the next two courses in the next two adjacent wales and then return to form each of the loops in the two adjacent stitch wales in the next two courses.

A review of FIG. 6, therefore, will indicate that the stitching yarn, for example, which forms the loop in course 50*a* in stitch wale 14*d* has its underlap 36*d* crossing over (as seen from the technical back side) the weft threads 1*d* and 3*d* and warp thread 4*d* to form the stitch loop in the next course 50*b* in the adjacent stitch wale 14*d*'. The underlap of that loop in course 50*b*, stitch wale 14*d*', crosses over weft yarn 5*d* and warp yarn 2*d* to form the loop in the next stitch wale 14*d*'' in the next course 50*c*. The underlap of that stitching yarn loop then returns, crossing warp 2*d* and weft 1*d* to form the loop in course 50*d*, stitch wale 14*d*', and then crosses wefts 3*d* and 5*d* and warp yarn 4*d* to form the loop in course 50*e*, stitch wale 14*d*. The underlap of adjacent stitch wales in the same course crosses over in the opposite direction. It will be noted that in each case, the weft yarns are located between the loop and the underlap of each stitch in each course, whether that underlap forms part of the same stitch or an adjacent stitch.

Figure 7:
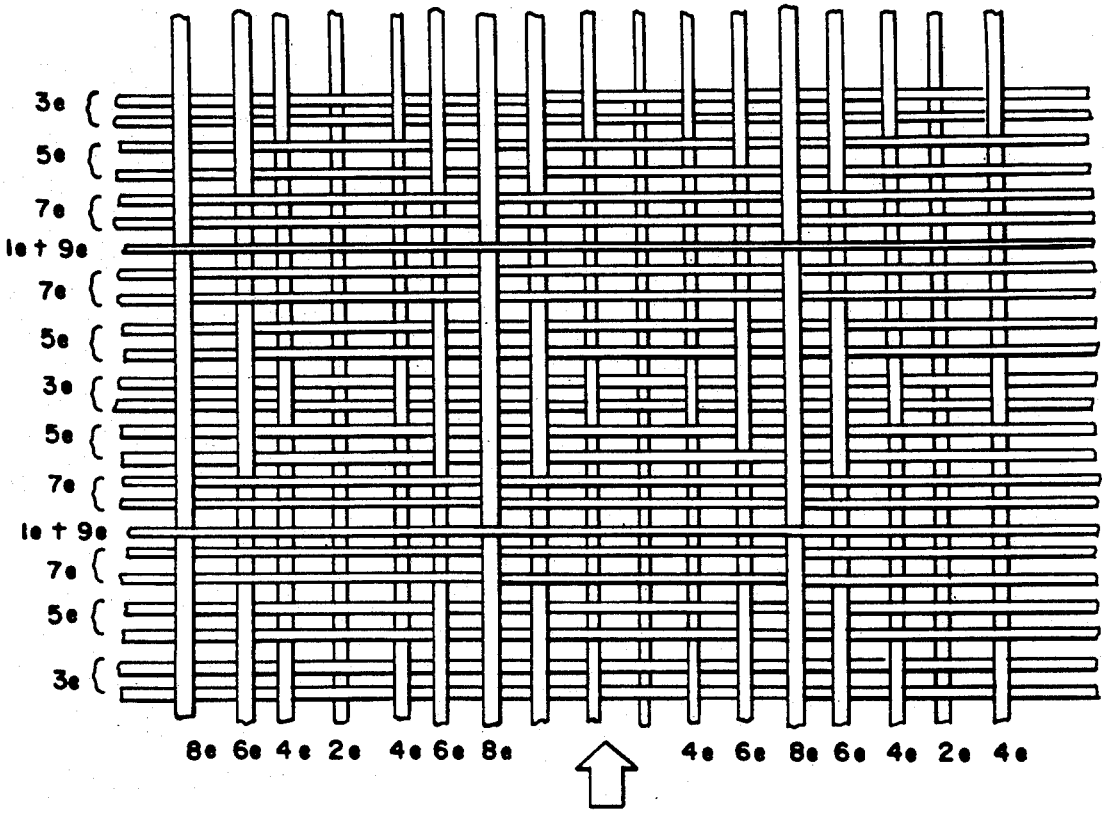
FIG. 7 is a fragmentary plan view illustrating another embodiment of the weft inserted, warp knit fabric hereof showing a repeating diamond configuration on its face.

Referring now to FIG. 7, there is illustrated a fabric construction having five weft yarns and four warp yarns with stitches, not shown, to form a definite pattern, for example, a series of relatively open-appearing diamond-shaped patterns adjacent one another in both warp and weft directions. Particularly, with the machine direction indicated by the arrow, the weft yarns include yarns 1*e*, 3*e*, 5*e*, 7*e* and 9*e* and the warp yarns include yarns 2*e*, 4*e*, 6*e* and 8*e*. More particularly, weft yarns 1*e* are initially laid down, followed by warp yarns 2*e*. Weft yarns 3*e* are laid on top of warp yarns 2*e*, and subsequently, warp yarns 4*e* are laid on top of weft yarns 3*e*. Weft yarns 5*e* are then laid on top of warp yarns 4*e* and warp yarns 6*e* are laid on top of weft yarns 5*e*. Weft yarns 7*e* are then laid on top of warp yarns 6*e*, followed by warp yarns 8*e* laid on top of weft yarns 7*e*. Finally, weft yarns 9*e* are laid on top of warp yarns 8*e*. Stitch yarns, not shown, lie between the warp yarns or between predetermined numbers of warp yarns. It will be noted that the weft yarns are slightly separated one from the other, although it will be appreciated that they could touch one another forming a tighter woven-like appearing fabric. Also, pairs of weft yarns are spaced one from the other in each course, with the exception of the single weft yarns 1*e* and 9*e*, which register one with the other on opposite sides of the fabric. Obviously, single or more than two weft yarns may be laid in each course.

It will be appreciated that a substantially diamond-appearing pattern is formed by the orthogonal intersections of the weft and warp yarns along imaginary diagonal lines of the interlaced yarns, as seen in FIG. 7. The diamond-appearing pattern is repeating in both the warp and weft directions.

The yarn used for the inserted wefts or laid-in warps in any of the embodiments hereof may be any desired yarn, including, but not limited to, filament and spun yarns of cotton, rayon, polyester, ramie, silk, nylon, Kevlar, Nomex, acetate or any other fiber. The various warp and weft yarns may be different from one another in one or more of size, composition, color and texture. The stitching yarn may be any suitable yarn capable of being stitched, with a fine denier, polyester filament yarn presently being preferred. As can be appreciated, one or more layers of a textile material may be included or substituted for a weft or warp yarn set. The textile material may be a non-woven, woven, knitted or netted material, as long as the stitching yarn can be stitched therethrough.

Figure 10:
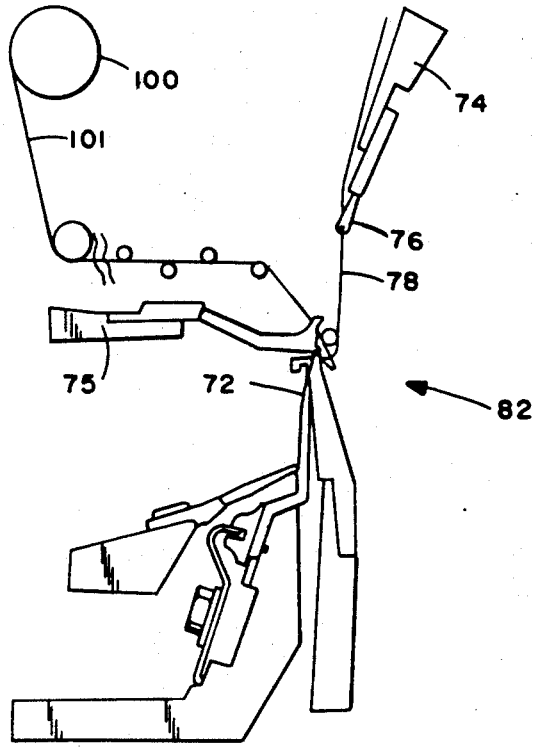
FIG. 10 is an enlarged schematic view of the knitting end of the apparatus illustrated in FIGS. 8 and 9.
Figure 8:
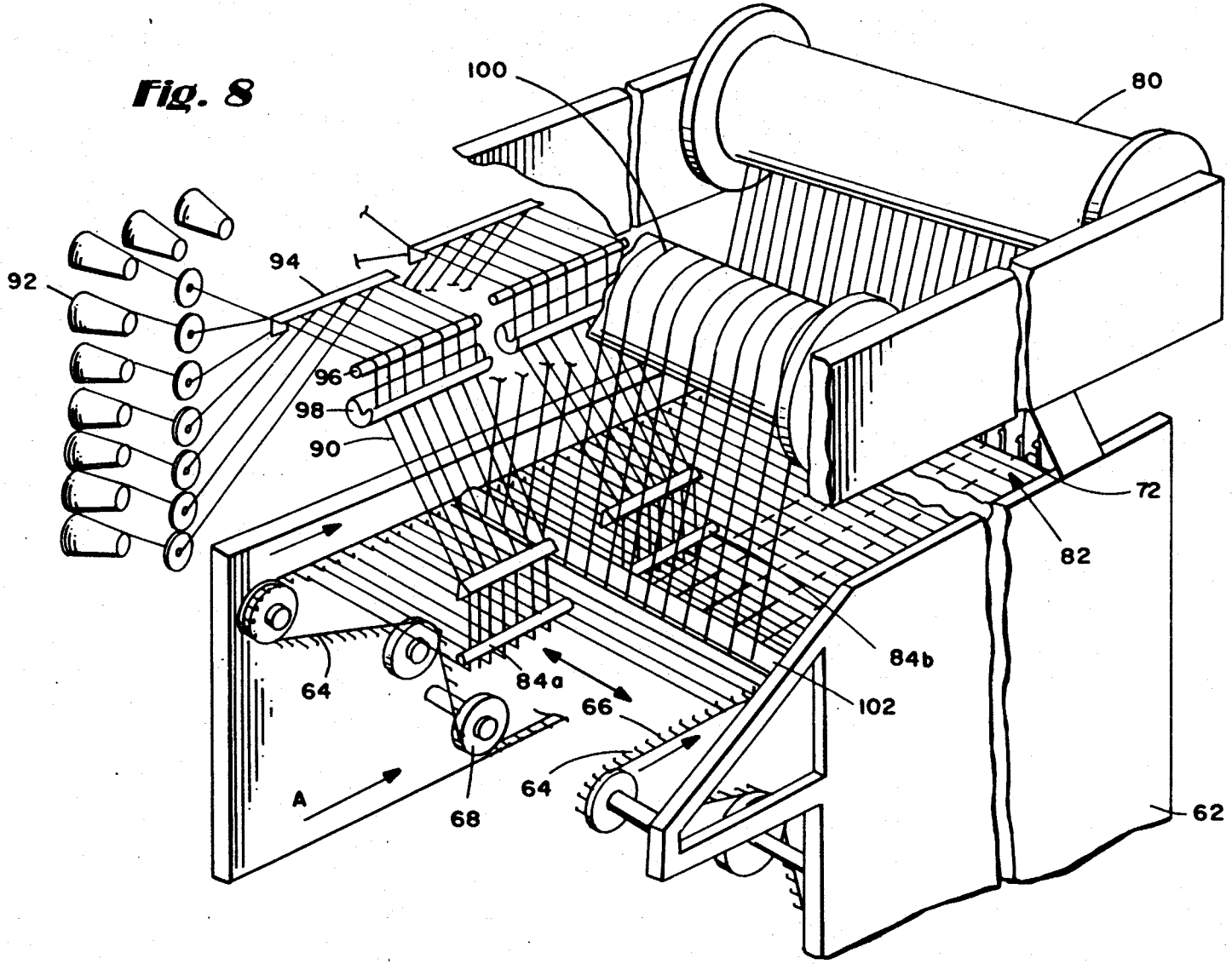
FIG. 8 is a schematic perspective view with parts broken out for ease of illustration of an apparatus for making the weft inserted, warp knit, woven look-alike fabric of the present invention.

Referring now to FIG. 8, there is disclosed apparatus for forming the knitted fabric according to the present invention. Particularly, the apparatus includes a conventional warp knitting machine modified in accordance with the present invention, as described below. Generally, the machine includes a base or frame 62 mounting a pair of endless carrier chains 64 on each side of the machine, the chains 64 having a plurality of upstanding pins 66 at closely spaced longitudinal positions therealong. The chains are disposed about suitable drive rollers 68 connected to a suitable drive mechanism, not shown, for advancing the generally horizontally disposed upper runs of chains 64 in the machine direction in the direction of the arrow A. At the downstream end of the machine, there is provided a reciprocating movable needle bar, carrying a plurality of stitching needles 72 which cooperate with guide bars 74 (FIG. 10), respectively carrying yarn guides 76 to form the warp knitting yarns 78 guided by guide bars 74 from a beam 80 (FIG. 8) carrying the stitching yarn into stitches at the knitting area, generally designated 82. In addition, weft feeders 75 (only one of which is shown in FIG. 10), position the inserted wefts properly during stitch formation and also serve to separate the interlacing warp yarns 101 from one another. Other mechanisms may be used for these purposes.

Referring back to FIG. 8, there ar provided two or more weft yarn carriers for laying in one or more weft yarns on the carrier chains 64. For example, two weft insertion carriages 84*a* and 84*b* are disclosed. The carriages 84*a* and 84*b* are transversely movable in the cross-machine direction as indicated by the double head arrow to reciprocate between the weft carrier chains 64 on opposite sides of the machine. Mechanisms for displacing a weft carriage are well known, may be employed to displace carriages 84*a* and 84*b* and therefore need not be described herein. It will be appreciated, however, that each of the weft carriages 84 lays one or more weft yarns 90 in the cross-machine direction on pins 66, the yarns 90 being taken from respective yarn cones 92 and routed through a series of guides 94, 96 and 98. It will be appreciated that while only two transversely movable weft carriages 84 are illustrated, additional weft carriages may be provided as desired, depending upon the number of laid-in weft yarns necessary to form a particular fabric.

Between each of the guide mechanisms and the weft carriages 84, there is disposed a beam 100 for carrying warp yarn. The warp yarn is disposed about a separator bar 102 which maintains the warp yarns parallel to one another, while they are being laid on top of the weft yarns. For example, the carriage 84*a* lays a set of weft yarns on the carrier chains 64 which advance the weft yarns below the separator bar 102. The warp yarns are then laid on top of the weft yarns, with the following weft carriage 84*b* laying its weft yarns on top of the laid-in warp yarns.

Figure 9:
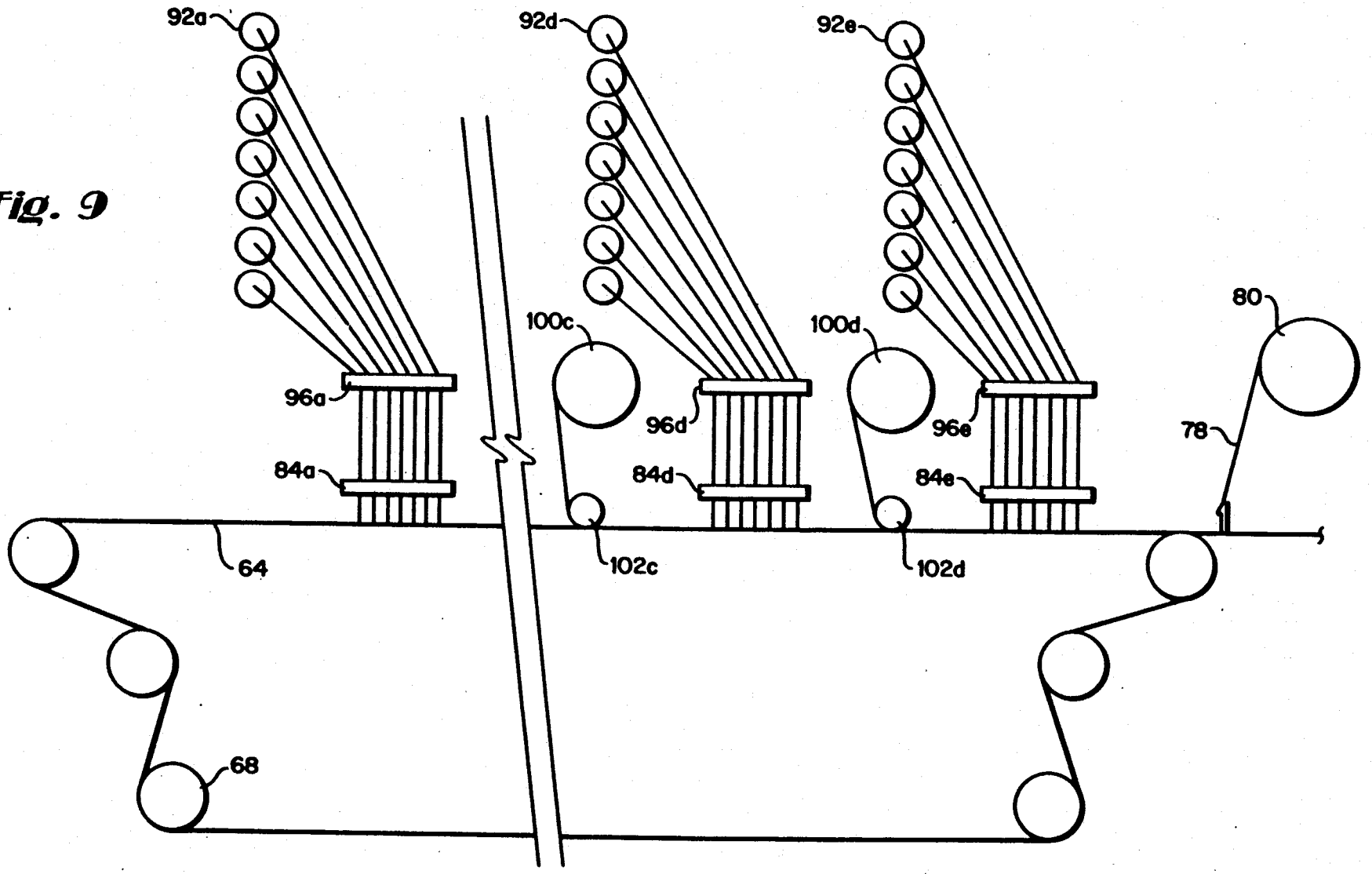
FIG. 9 is a schematic side elevational view of the apparatus illustrated in FIG. 8.

It will be appreciated that additional warp yarn carrying beams are provided with the warp yarns being guided to additional separator bars between adjacent pairs of weft carriages. This is particularly schematically illustrated in FIG. 9, which discloses an arrangement for forming the fabric illustrated in FIG. 7 having five weft and four warp yarn sets. For example, weft yarn carriages 84*a*–84*e* are spaced one from the other along the machine in the machine direction. Disposed between adjacent pairs thereof is a warp beam 100 and a separator bar 102. Thus, between adjacent weft carriages 84*a* and 84*b*; 84*b* and 84*c*; 84*c* and 84*d*; and 84*d* and 84*e*, there is provided warp beams and separator bars 100*a* and 102*a*; 100*b* and 102*b*; 100*c* and 102*c*; and 100*d*, respectively. Consequently, it will be appreciated that any number of weft and warp yarn sets may be interlaced depending upon the nature of the desired fabric.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The woven look features disclosed herein may be combined with any known or conventional warp knitting capabilities, including the incorporation of woven or non-woven substrates into the fabric, the use patterning guide bars that add warp yarns to the fabric at the knitting portion of the machine, the use of all suitable stitch combinations, and the like.

What is claimed is:

1. A warp knit, weft inserted, fabric having selvages along opposite sides and a woven-like appearance, comprising:

plural stitch wales having a plurality of substantially parallel courses and a stitch in each wale at each course having a technical face side and a technical back side;

a first set of weft yarns each of which is held in the fabric by the technical back sides of predetermined ones of said stitches;

a second set of weft yarns each of which is held in the fabric by the technical face sides of predetermined ones of said stitches and spaced along said fabric from said firs set of weft yarns; and each of said first set of weft yarns and said second set of weft yarns extending to and between the selvages along opposite sides of the fabric; and each weft yarn being longitudinally spaced along the fabric from each other weft yarn in the fabric;

plural warp yarns spaced form one another disposed between said firs and second sets of weft yarns and extending in a warp direction between predetermined stitch wales;

whereby said first and second sets of weft yarns and said warp yarns are interlaced one with another such that at least one side of the fabric has said woven-like appearance.

2. A fabric according to claim 1 wherein said technical face and back side of each stitch includes a loop portion and an underlap portion thereof, all of the weft yarns of said first and second sets thereof lying between the loop portion and underlap portions of said stitches.

3. A fabric according to claim 1 wherein the weft yarns of said first and second sets thereof lie in alternating courses.

4. A fabric according to claim 3 wherein said alternating courses lie next adjacent one another.

5. A fabric according to claim 1 wherein at least one of the weft yarns of said first set thereof lies in a same course with at least one of the weft yarns of said second set thereof.

6. A fabric according to claim 1 wherein none of the weft yarns of said first set lie in a same course with any of the weft yarns of said second set thereof.

7. A fabric according to claim 1 wherein none of the weft yarns overlie a technical face side segment when the fabric is viewed from the technical face side.

8. A fabric as claimed in claim 1 in which a woven or non-woven substrate is included in the fabric.

9. A fabric as claimed in claim 1 in which laid in warp yarns are held to the fabric outside of said first and second weft yarn sets.

10. A fabric according to claim 1 wherein no weft yarns of said first set of weft yarns lie int eh same course as weft yarns of said second set of weft yarns, and no weft yarns of said second set of weft yarns lie in the same course as weft yarns of said first set of weft yarns.

11. A warp knit, weft inserted, fabric having a woven-like appearance, comprising:

plural chain stitch wales extending in a warp direction and having a plurality of substantially parallel courses with the stitch in each wale at each course having a loop and an underlap;

a first set of weft yarns each being respectively inserted in those of said chain stitches which establish selected ones of said courses such that predetermined adjacent ones of said first weft yarns are spaced form one another in the warp direction by others of said chain stitches which establish at least one intermediate course between said selected ones of said courses in which said predetermined adjacent ones of said first weft yarns are inserted;

a second set of weft yarns each inserted in a respective said at least one intermediate course;

each of said at least one intermediate course receiving a weft yarn of said second set lying next adjacent one of said selected ones of said courses receiving a weft yarn of said first set with the weft yarns of said next adjacent courses bound to the fabric by underlaps of the stitches;

each weft yarn being longitudinally spaced along the fabric from each other weft yarn in the fabric; and plural wrap yarns disposed between said first and second sets of weft yarns and extending in the wrap direction between predetermined adjacent stitch wales.

12. A fabric according to claim 11 wherein said fabric has a technical face, all of the weft yarns of said first and second sets thereof lying below the loops of said stitches as viewed from said technical face side of said fabric.

13. A fabric according to claim 11 wherein said predetermined ones of said first weft yarns are spaced apart from one-another in the warp direction by others of said chain stitches which establish at least two intermediate courses between said selected ones of said courses with said second set of weft yarns inserted into one of said two intermediate courses, a third set of weft yarns each inserted in the other of said two intermediate courses, the yarns of the first, second and third sets thereof lying sequentially adjacent one another in the warp direction and being bound to the fabric by the underlap of the stitches.

14. A fabric according to claim 11 wherein none of the weft yarns overlie the loop when the fabric is viewed from the technical face side.

15. A fabric according to claim 12 wherein no weft yarns of said first set of weft yarns lie in the same course as weft yarns of said second set of weft yarns, and no weft yarns of said second set of weft yarns lie in the same course as weft yarns of said first set of weft yarns.

16. A warp knit weft inserted fabric having a laid-in warp and a relatively open woven appearance comprising;

a first layer of spaced-apart laid-in weft yarns;

a second layer of laid-in spaced-apart warp yarns;

a third layer of laid-in spaced-apart weft yarns longitudinally spaced along said fabric from said first layer of weft yarns, wherein the weft yarns of said third layer are not in registration with the weft yarns of said first layer;

said first, second and third layers being held together by relatively fine warp stitching yarns such that the yarns of said three layers have an interlaced woven-like appearance;

no weft yarns of said first layer of weft yarns lying in the same course as weft yarns of said third layer of weft yarns, and no weft yarns of said third layer of weft yarns lying in the same course as weft yarns of said first layer of weft yarns.

17. The fabric of claim 16 wherein said layers are held together by the stitching such that the yarns are disposed in essentially a single plane, except at cross-over points.

18. The fabric of claim 16 wherein the spaced-apart weft yarns of said first layer overlay the warp yarns at cross-over points and wherein the warp yarns overlay the spaced-apart yarns of said third weft layer at cross-over points.

19. A warp knit, weft inserted, fabric having selvages along opposite sides and a woven-like appearance, comprising:

plural stitch wales having a plurality of substantially parallel courses with the stitch in each wale at each course having a technical face side and a technical back side;

a first set of weft yarns each of which is held in the fabric by the technical back sides of predetermined ones of said stitches;

a second set of weft yarns each of which is held in the fabric by the technical face sides of predetermined ones of said stitches and spaced along said fabric from said first set of weft yarns;

each of said first set of weft yarns and said second set of weft yarns extending to and between the selvages along opposite sides of the fabric; and plural warp yarns spaced from one another disposed between said first and second sets of weft yarns and extending in a warp direction between predetermined stitch wales;

said weft yarns being absent from at least one of said courses;

whereby said first and second sets of weft yarns and said warp yarns are interlaced one with another such that at least one side of the fabric has said woven-like appearance;

wherein weft yarns are absent from at least one of said courses.

20. A warp knit, weft inserted, fabric having selvages along opposite sides and a woven-like appearance, comprising:

plural stitch wales having a plurality of substantially parallel courses with the stitch in each wale at each course having a technical face side and a technical back side;

a first set of weft yarns each of which is held in the fabric by the technical back sides of predetermined ones of said stitches;

a second set of weft yarns each of which is held in the fabric by the technical face sides of predetermined ones of said stitches and spaced along said fabric from said first set of weft yarns; and each of said first set of weft yarns and said second set of weft yarns extending to and between the selvages along opposite sides of the fabric; and plural warp yarns spaced from one another disposed between said first and second sets of weft yarns and extending in a warp direction between predetermined stitch wales;

predetermined ones of said first set of weft yarns being spaced apart form one-another in the warp direction by a plurality of stitch courses establishing at least two intermediate courses between selected ones of said courses, said second set of weft yarns being inserted into one of said two intermediate courses, a third set of weft yarns inserted in another of said two intermediate courses, the weft yarns of the first, second and third sets thereof lying in sequence in the warp direction and being bound to the fabric by an underlap of said technical back side or a loop of said technical face side of the stitches, and plural warp yarns disposed between said second and third sets of weft yarns and extending in the warp direction between predetermined stitch wales;

whereby said first, second and third sets of weft yarns and said warp yarns are interlaced one with another such that least one side of the fabric has said woven-like appearance.

21. A fabric according to claim 20 wherein at least one of the weft yarns of one of said sets thereof lie in an identical course with at least one of the weft yarns of another of said sets thereof.

22. A warp knit, weft inserted, fabric having selvages along opposite sides and a woven-like appearance, comprising;

plural stitch wales having a plurality of substantially parallel courses with the stitch in each wale at each course having a technical face side and a technical back side;

a first set of weft yarns each of which is held in the fabric by the technical back sides of predetermined ones of said stitches;

a second set of weft yarns each of which is held in the fabric by the technical face sides of predetermined ones of said stitches and spaced along said fabric form said first set of weft yarns; and each of said first set of weft yarns and said second set of weft yarns extending to and between the selvages along opposite sides of the fabric;

an unequal number of weft yarns being inserted in the stitches of the next adjacent courses; and plural warp yarns spaced from one another disposed between said first and second sets of weft yarns and extending n a warp direction between predetermined stitch wales;

whereby said first and second sets of weft yarns and said warp yarns are interlaced one with another such that at least one side of the fabric has said woven-like appearance.

23. A warp knit, weft inserted, fabric having a woven-like appearance, comprising:

plural chain stitch wales having a plurality of substantially parallel courses with the stitch in each wale at each course having a loop and an underlap;

a first set of weft yarns each being respectively inserted in those of said chain stitches which establish selected ones of said courses such that predetermined adjacent ones of said first weft yarns are spaced one from the other in the warp direction by others of said chain stitches which establish at least one intermediate course between said selected ones of said courses in which said predetermined adjacent ones of said first weft yarns are inserted;

a second set of weft yarns each inserted in a respective said at least one intermediate course;

each of said at least one intermediate course receiving a weft yarn of said second set laying next adjacent one of said selected ones of said courses receiving a weft yarn of said first set with the weft yarns of said next adjacent courses bound to the fabric by the underlap of the stitches;

an unequal number of weft yarns are inserted in the stitches in the next adjacent courses thereof in comparison with the number of weft yarns inserted in said one of said selected ones of said courses; and plural warp yarns disposed between said first and second sets of weft yarns and extending in the warp direction between predetermined adjacent stitch wales.

24. A warp knit, weft inserted, fabric having selvages along opposite sides and a woven-like appearance, comprising:

plural stitch wales having a plurality of substantially parallel courses with the stitch in each wale at each course having a technical face side and a technical back side;

a first set of weft yarns each of which is held in the fabric by the technical back sides of predetermined ones of said stitches;

a second set of weft yarns each of which is held in the fabric by the technical face sides of predetermined ones of said stitches and spaced along said fabric from said first set of weft yarns; and each of said first set of weft yarns and said second set of weft yarns extending to and between the selvages along opposite sides of the fabric;

plural warp yarns spaced from one another disposed between said first and second sets of weft yarns and extending in a warp direction between predetermined stitch wales; and additional weft yarns is provided between said first and second sets of weft yarn set and an additional layer of warp yarns provided between said additional weft yarn set and a next adjacent weft yarn set.

25. A warp knit weft inserted fabric having a laid-in warp and a relatively open woven appearance comprising:

a first layer of spaced-apart laid-in weft yarns;

a second layer of laid-in spaced-apart warp yarns; and a third layer of laid-in spaced-apart weft yarns; wherein the weft yarns of said third layer are not in registration with the weft yarns of said first layer;

said first, second and third layers being held together by relatively fine warp stitching yarns such that the yarns of said three layers have an interlaced woven-like appearance; and a fourth layer of spaced-apart, laid-in warp yarns wherein the yarns of said fourth layer are not in registration with the yarns of said second layer.

26. The fabric of claim 25 including a further layer of spaced-apart laid-in weft yarns wherein the yarns of said further layer are not in registration with the weft yarns of said first and thrid layers.

27. The fabric of claim 26 wherein the fourth layer of spaced-apart laid-in warp yarns overlie said further layer of spaced-apart laid-in yarns.

28. A warp knit weft inserted fabric having a laid-in warp and a relatively open woven appearance comprising:

a first layer of spaced-apart laid-in weft yarns;

a second layer of laid-in spaced-apart warp yarns; and a third layer of laid-in spaced-apart weft yarns, wherein the weft yarns of said third layer are not in registration with the weft yarns of said first layer;

said first, second and third layers being held together by relatively fine warp stitching yarns such that the yarns of said three layers have an interlaced woven-like appearance; and a further layer of spaced-apart laid-in weft yarns wherein the yarns of said further layer are not in registration with the weft yarns of said first and third layers.

* * * * *